US011003121B2

(12) United States Patent
Nishikawa et al.

(10) Patent No.: US 11,003,121 B2
(45) Date of Patent: May 11, 2021

(54) PRINTING EQUIPMENT AND PRINTING METHOD

(71) Applicant: KONICA MINOLTA, INC., Tokyo (JP)

(72) Inventors: Eiji Nishikawa, Tama (JP); Takahiro Yokoya, Tama (JP)

(73) Assignee: Konica Minolta, Inc., Tokyo (JP)

( * ) Notice: Subject to any disclaimer, the term of this patent is extended or adjusted under 35 U.S.C. 154(b) by 241 days.

(21) Appl. No.: 15/969,064

(22) Filed: May 2, 2018

(65) Prior Publication Data

US 2018/0329347 A1 Nov. 15, 2018

(30) Foreign Application Priority Data

May 9, 2017 (JP) ..... JP2017-092873

(51) Int. Cl.
*G03G 15/00* (2006.01)

(52) U.S. Cl.
CPC ..... *G03G 15/5029* (2013.01); *G03G 15/5062* (2013.01); *G03G 15/652* (2013.01); *G03G 15/6558* (2013.01); *G03G 15/70* (2013.01); *G03G 2215/00548* (2013.01); *G03G 2215/00599* (2013.01)

(58) Field of Classification Search
CPC ..... G03G 15/5029; G03G 15/5062; G03G 15/652; G03G 15/6558; G03G 15/70; G03G 15/00548; G03G 2215/00548; G03G 2215/00599
See application file for complete search history.

(56) References Cited

U.S. PATENT DOCUMENTS 6,496,672 B2 * 12/2002 Asuwa ..... G03G 15/1605 399/165
2002/0078845 A1 * 6/2002 Tokiwa ..... B41F 31/08 101/365

(Continued)

FOREIGN PATENT DOCUMENTS

JP H08324062 A 12/1996
JP 2006276427 A 10/2006

(Continued)

OTHER PUBLICATIONS

Notice of Reasons for Refusal issued in corresponding Japanese Patent Application No. 2014-092873, dated Mar. 2, 2021, with English translation.

*Primary Examiner* — David H Banh
(74) *Attorney, Agent, or Firm* — Buchanan Ingersoll & Rooney PC

(57) ABSTRACT

There is provided printing equipment that enhances the overprinting position accuracy in overprinting and a printing method for the printing equipment. In the printing method, a paper meandering profile acquisition part acquires a meandering profile of paper from a result of detection by a paper deviation detection sensor. A paper speed profile acquisition part acquires a paper speed profile from a result of detection by a paper conveyance speed detection sensor. A paper feed error calculator calculates a paper feed error on the basis of the meandering profile and paper speed profile. A paper feed error corrector corrects the image formation timing on the basis of a result of calculation by the paper feed error calculator.

8 Claims, 7 Drawing Sheets

(56) References Cited

U.S. PATENT DOCUMENTS

| | | | | |
|---|---|---|---|---|
| 2005/0219557 | A1* | 10/2005 | Koike | B41J 11/007 358/1.1 |
| 2008/0095560 | A1 | 4/2008 | Larson et al. | |
| 2013/0161900 | A1* | 6/2013 | Takahashi | G03G 15/0189 271/228 |
| 2014/0198152 | A1* | 7/2014 | Hori | B41J 11/0095 347/22 |
| 2016/0121627 | A1* | 5/2016 | Yoshida | B41J 11/008 347/16 |
| 2016/0299463 | A1* | 10/2016 | Furukawa | G03G 15/6529 |
| 2016/0311638 | A1* | 10/2016 | Minato | B65H 23/1888 |
| 2018/0022119 | A1* | 1/2018 | Kamigiku | B41J 13/0009 347/16 |
| 2018/0272768 | A1* | 9/2018 | Usumoto | G03G 15/50 |

FOREIGN PATENT DOCUMENTS

| | | | |
|---|---|---|---|
| JP | 2007-091347 | A | 4/2007 |
| JP | 2008155628 | A | 7/2008 |
| JP | 2009190268 | A | 8/2009 |
| JP | 2009258521 | A | 11/2009 |
| JP | 2011189602 | A | 9/2011 |
| JP | 2012078545 | A | 4/2012 |
| JP | 2013176868 | A | 9/2013 |
| JP | 2016055570 | A | 4/2016 |
| JP | 2016117246 | A | 6/2016 |

* cited by examiner

PRINTING EQUIPMENT AND PRINTING METHOD

CROSS-REFERENCE TO RELATED APPLICATIONS

The entire disclosure of Japanese Patent Application No. 2017-92873, filed on May 9, 2017, is incorporated herein by reference in its entirety.

TECHNOLOGICAL FIELD

The present invention relates to printing equipment and a printing method.

BACKGROUND

In the printing equipment field, an overprinting technique, a technique to make a print again on a surface on which a print has been once made, is known. In printing equipment with an overprinting function, in order to ensure the accuracy of an overprinting position (position where overprinting is to be done), instability in paper feed must be minimized For this reason, a technique to stabilize the paper feed rate of paper conveying rollers by suppressing the instability in rotation of the paper feed motor is employed.

However, contributory factors for instability in paper feed or paper feed errors include not only instability in the paper feed rate of paper conveying rollers (namely, paper conveyance speed) but also instability caused by fluctuations in travel path due to meandering in the width direction of the paper (hereinafter sometimes referred to as "paper meandering"). Therefore, it is difficult to suppress the instability in paper feed (namely stabilize the paper feed) merely by stabilizing the paper feed rate of paper conveying rollers.

As a technique related to paper meandering, a technique to detect the amount of paper meandering and correct the image position in the main scanning direction is known (for example, see Patent Literature 1). Patent Literature 1 describes that meandering which occurs during conveyance of continuous form paper is detected by a displacement detection sensor, the amount of shift of print data per line in the width direction is calculated on the basis of the result of detection by the displacement detection sensor, and image recording is performed while print data per line is being corrected.

DESCRIPTION OF THE RELATED ART

Patent Literature 1: JP-A-2007-91347

SUMMARY

The related art described in Patent Literature 1 is a technique which detects the amount of paper meandering and corrects the image position in the main scanning direction for the purpose of preventing image quality deterioration caused by paper meandering. However, the related art described in Patent Literature 1 does not consider suppressing paper feed errors (instability in paper feed) caused by paper meandering.

The present invention has an object to provide printing equipment and a printing method that enhance the overprinting position accuracy in overprinting by correcting paper feed errors in consideration of meandering in the width direction of paper.

To achieve at least one of the abovementioned objects, according to an aspect of the present invention, printing equipment reflecting one aspect of the present invention includes:

a paper deviation detector for detecting deviation of paper being conveyed, in a main scanning direction;

a paper meandering profile acquisition part for acquiring a profile of meandering in a width direction of the paper from a result of detection by the paper deviation detector;

a paper feed error calculator for calculating a paper feed error on the basis of the meandering profile acquired by the paper meandering profile acquisition part; and a corrector for correcting image formation timing on the basis of a result of calculation by the paper feed error calculator.

Furthermore, a printing method reflecting one aspect of the present invention is a printing method for printing equipment having a paper deviation detector for detecting deviation of paper being conveyed, in a main scanning direction. The method uses a non-transitory computer-readable storage medium storing a program causing a computer to perform:

acquiring a profile of meandering in a width direction of the paper from a result of detection by the paper deviation detector (paper meandering profile acquisition step);

calculating a paper feed error on the basis of the meandering profile acquired at the paper meandering profile acquisition step (paper feed error calculation step); and correcting image formation timing on the basis of a result of calculation at the paper feed error calculation step (correction step).

BRIEF DESCRIPTION OF THE DRAWINGS

The advantages and features provided by one or more embodiments of the invention will become more fully understood from the detailed description given below and the appended drawings which are given by way of illustration only, and thus are not intended as a definition of the limits of the present invention.

DETAILED DESCRIPTION OF EMBODIMENTS

Hereinafter, one or more embodiments of the present invention will be described with reference to the drawings. However, the scope of the invention is not limited to the disclosed embodiments. In the explanation given below and the drawings, the same elements or elements with the same functions are designated by the same reference signs and descriptions thereof are not repeated.

<System Configuration of the Printing Equipment>

Figure 1:
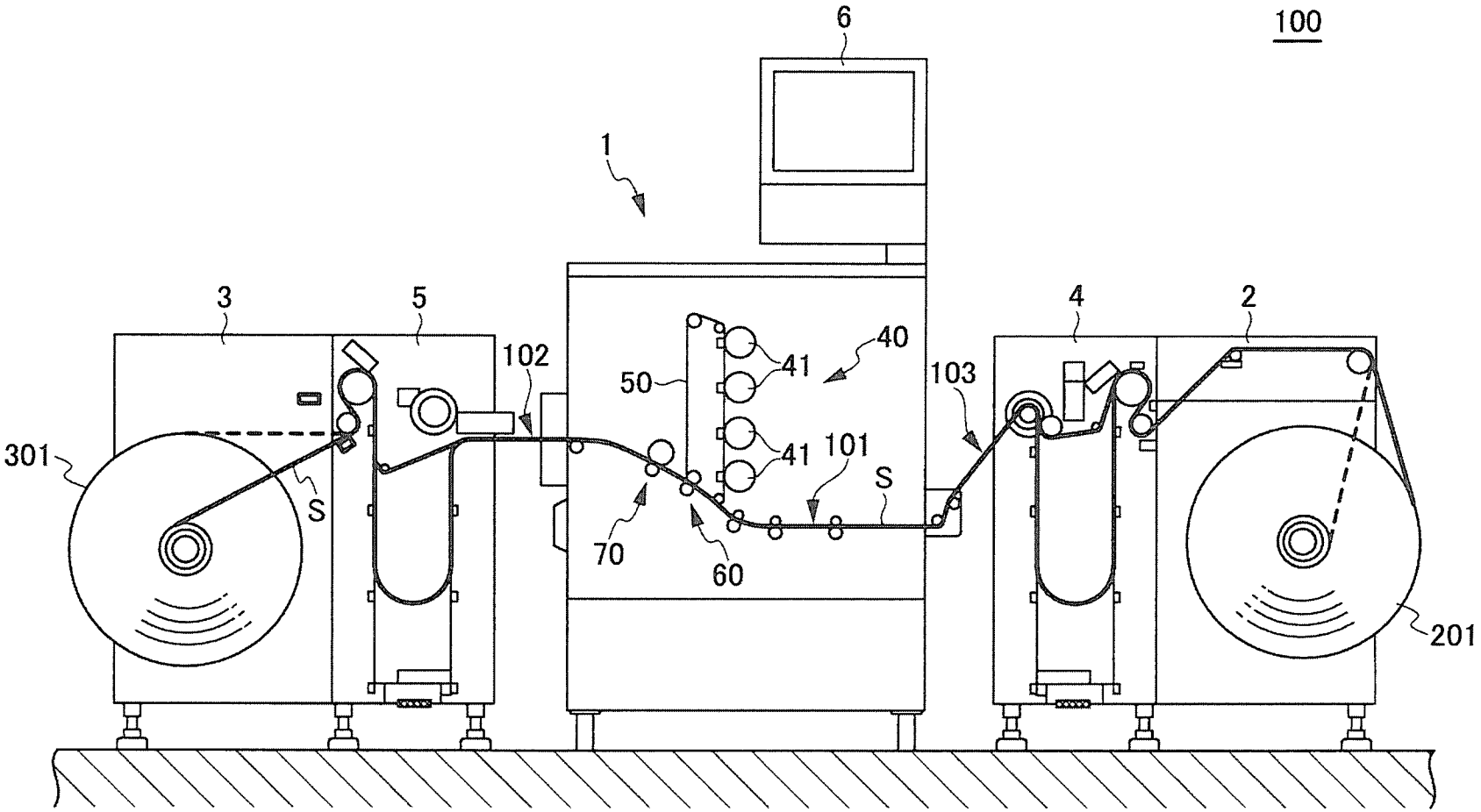
FIG. 1 is a system configuration diagram which schematically shows the system configuration of printing equipment according to an embodiment of the present invention.

FIG. 1 is a system configuration diagram which schematically shows the system configuration of printing equipment according to an embodiment of the present invention. As shown in FIG. 1, the printing equipment 100 according to the embodiment includes an image forming apparatus 1, paper feed device 2 for feeding continuous paper S to the image forming apparatus 1, and paper take-up device 3 for winding up the printed paper S discharged from the image forming apparatus 1. In short, the printing equipment 100 according to this embodiment is continuous paper printing equipment which performs printing on continuous paper.

The continuous paper S which is handled by the printing equipment 100 according to this embodiment is continuous paper such as rolled paper (long paper) or paper wound in the form of a roll. Here, the printing equipment 100 according to this embodiment is exemplified by continuous paper printing equipment, but the invention is not limited to continuous paper printing equipment. In other words, the printing equipment 100 according to this embodiment can also be a stand-alone image forming apparatus 1.

The paper feed device 2, located on the earlier stage side before the image forming apparatus 1 (upstream in the feed direction of continuous paper S), holds a continuous paper body 201 around which continuous paper S is wound, in a rotatable manner and supplies the continuous paper S to the image forming apparatus 1. A paper feed adjuster 4 is provided on the image forming apparatus 1 side of the paper feed device 2. The paper feed adjuster 4 has the buffer function to absorb a slight speed difference and deviation between the paper feed device 2 and the image forming apparatus 1.

The paper take-up device 3, located on the later stage side after the image forming apparatus 1 (downstream in the feed direction of the continuous paper S), winds up the continuous paper S discharged from the image forming apparatus 1 through a rewinder 301 and holds the paper in the form of a roll. A discharged paper adjuster 5 is provided on the image forming apparatus 1 side of the paper take-up device 3. The discharged paper adjuster 5 has the buffer function to absorb a slight speed difference and deviation between the paper take-up device 3 and the image forming apparatus 1.

An operation display 6 is provided on the top of the image forming apparatus 1. The operation display 6 is a touch panel which combines, for example, a panel display such as a liquid crystal display (LCD) or organic EL (Electro Luminescence) display, and a position input device such as a touch pad. The operation display 6 shows a menu of instructions to the user, information related to acquired image data and so on. In addition, the operation display 6 includes a plurality of keys and has a function as an input unit which receives data entered through key operation by the user, including various instructions, characters, and numerals.

[General Configuration of the Image Forming Apparatus]

Figure 2:
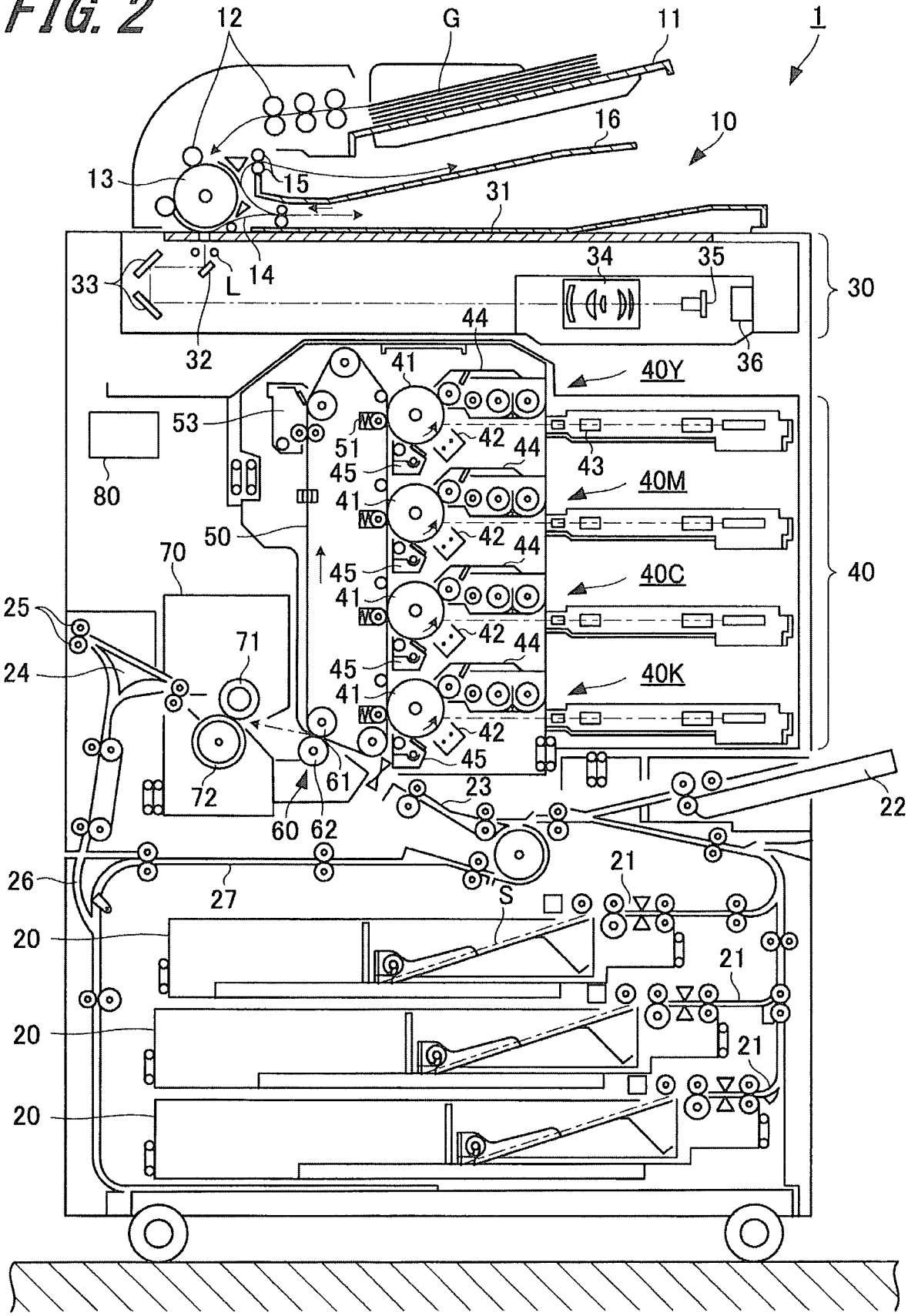
FIG. 2 is a general configuration diagram which schematically shows the configuration of an image forming apparatus.

Next, the general configuration of the image forming apparatus 1 will be described referring to FIG. 2. FIG. 2 is a general configuration diagram which schematically shows the configuration of the image forming apparatus. The image forming apparatus 1 according to this embodiment is a tandem color image forming apparatus based on an electrophotographic method using static electricity to form an image, in which four color toners, yellow (Y), magenta (M), cyan (C), and black (K), are superimposed one upon another. As shown in FIG. 2, the image forming apparatus 1 according to this embodiment includes an original conveyor 10, paper case 20, image reader 30, image forming section 40, intermediate transfer belt 50, secondary transfer part 60, fixing section 70, and control board 80. The image forming apparatus 1 according to this embodiment further includes a paper deviation detection sensor 101, paper conveyance speed detection sensor 102, and overprint mark detection sensor 103 (see FIG. 3).

The original conveyor 10 includes an original feed tray 11 on which an original G is placed, a plurality of rollers 12, conveyance drum 13, conveyance guide 14, original discharge rollers 15, and original discharge tray 16. Originals G placed on the original feed tray 11 are conveyed one by one to the reading position in the image reader 30 by the rollers 12 and conveyance drum 13. The conveyance guide 14 and original discharge rollers 15 discharge the original G conveyed by the rollers 12 and conveyance drum 13, to the original discharge tray 16.

The image reader 30 reads the image of the original G conveyed by the original conveyor 10 or an original placed on an original holder 31 and generates image data. Specifically, the image of the original G is irradiated by a lamp L. The reflected light from the original G irradiated with light from the lamp L is guided by a first mirror unit 32, second mirror unit 33, and lens unit 34 sequentially to the light receiving surface of an imaging element 35 where an image is formed. The imaging element 35 photo-electrically converts the incoming light and outputs a given image signal. The image signal sent from the imaging element 35 is A/D converted to generate image data.

The image reader 30 includes an image processor 36. The image processor 36 processes the image data generated by the A/D conversion in the image reader 30, using known image processing techniques such as shading correction, dithering and compression. Then, the image processor 36 stores the processed image data in a RAM 903 (see FIG. 3) of a controller 90 mounted on the control board 80. Image data is not limited to data sent from the image reader 30; instead, image data may be data received from an external device such as a personal computer connected to the image forming apparatus 1 or another image forming apparatus.

The paper case 20 is located in the lower part of the apparatus body. Several paper cases are provided according to the size and type of paper S as an example of a recording medium. The paper S is sent to a conveyor 23 by a paper feeder 21 and conveyed by the conveyor 23 to the secondary transfer part 60 as a transfer position. A manual paper feeder 22 is provided near the paper case 20. A sheet of paper different in size from the sheets housed in the paper case 20, or a special sheet such as a tag sheet or OHP sheet is placed in the manual paper feeder 22 by the user and sent to the transfer position.

The image forming section 40 and intermediate transfer belt 50 are located between the image reader 30 and the paper case 20. The image forming section 40 includes four image forming units 40Y, 40M, 40C and 40K to form color toner images of yellow (Y), magenta (M), cyan (C), and black (K).

The image forming unit 40Y forms a yellow toner image and the image forming unit 40M forms a magenta toner image. The image forming unit 40C forms a cyan toner image and the image forming unit 40K forms a black toner image. These four image forming units 40Y, 40M, 40C, and 40K have the same structure. Thus, the image forming unit 40Y, which forms a yellow toner image, is described below.

The image forming unit 40Y includes a drum-like photoreceptor (photoreceptor drum) 41, electrifying part 42 placed around the photoreceptor 41, exposure part 43, development part 44, and first cleaning device 45. The photoreceptor 41 is driven by a drive motor (not shown) to rotate. The electrifying part 42 gives electric charge to the photoreceptor 41 to electrify the surface of the photoreceptor 41 evenly. The exposure part 43 exposes the surface of the photoreceptor 41 to light according to the image data read from the original G or the image data sent from an external device to form an electrostatic latent image on the photoreceptor 41.

The development part 44 develops the electrostatic latent image formed on the photoreceptor 41 using a 2-component developer containing toner and carrier. Toner is particles to form an image. Carrier has the function to give appropriate electric charge to toner by frictional electrification in mixing with toner in the development part 44, the function to convey the toner to the development area facing the photoreceptor 41, and the function to generate a development field to enable the toner to develop an image faithful to the electrostatic latent image on the photoreceptor 41. The development part 44 makes the yellow toner adhere to the electrostatic latent image formed on the photoreceptor 41. Consequently, a yellow toner image is formed on the surface of the photoreceptor 41.

The development part 44 of the image forming unit 40M makes the magenta toner adhere to the photoreceptor 41 of the image forming unit 40M. The development part 44 of the image forming unit 40C makes the cyan toner adhere to the photoreceptor 41 of the image forming unit 40C. The development part 44 of the image forming unit 40K makes the black toner adhere to the photoreceptor 41 of the image forming unit 40K.

The first cleaning device 45 cleans the surface of the photoreceptor 41 after the toner adhering to the photoreceptor 41 is transferred to the intermediate transfer belt 50. Specifically, the first cleaning device 45 removes residues (accretion) such as toner remaining on the surface of the photoreceptor 41 (residual toner).

The toner adhering to the photoreceptor 41 is transferred to the intermediate transfer belt 50. The intermediate transfer belt 50 is endless and wound around several rollers. The intermediate transfer belt 50 is driven by a drive motor (not shown) to rotate clockwise, or in the direction opposite to the direction of rotation of the photoreceptor 41. A primary transfer part 51 is provided on the intermediate transfer belt 50 at a point corresponding to the photoreceptor 41 of each of the image forming units 40Y, 40M, 40C, and 40K.

The primary transfer part 51 transfers the toner adhering to the photoreceptor 41 to the intermediate transfer belt 50 by applying a voltage with opposite polarity to the polarity of the toner. As the intermediate transfer belt 50 rotates, the toner images formed by the four image forming units 40Y, 40M, 40C, and 40K are sequentially transferred to the surface of the intermediate transfer belt 50. Consequently, the yellow, magenta, cyan, and black toner images are superimposed to form a color image on the intermediate transfer belt 50.

A second cleaning device 53 is located opposite to the intermediate transfer belt 50. The second cleaning device 53 cleans the surface of the intermediate transfer belt 50 after the toner images transferred to the intermediate transfer belt 50 are transferred to the paper S. Specifically, the second cleaning device 53 removes residues (accretion) such as toner (residual toner) remaining on the surface of the intermediate transfer belt 50.

The secondary transfer part 60 is located near the intermediate transfer belt 50 on the downstream side in the paper conveying direction of the conveyor 23. The secondary transfer part 60 includes a pair of transfer rollers which are an upper transfer roller 61 across which the intermediate transfer belt 50 is laid, and a lower transfer roller 62 pressed toward the upper transfer roller 61 with the intermediate transfer belt 50 between the upper and lower rollers. The secondary transfer part 60 causes the paper S conveyed by the conveyor 23 to contact the intermediate transfer belt 50 to transfer the toner image formed on the outer surface of the intermediate transfer belt 50 to the paper S.

The fixing section 70 is located on the paper S discharge side of the secondary transfer part 60. The fixing section 70 pressurizes and heats the paper S to fix the transferred toner image on the paper S. For example, the fixing section 70 includes a pair of fixing members which are an upper fixing roller 71 and a lower fixing roller 72. The upper fixing roller 71 and lower fixing roller 72 are in pressure contact with each other so that the area of pressure contact between the upper fixing roller 71 and lower fixing roller 72 forms a fixing nip part.

A heater is built in the upper fixing roller 71. The roller portion of the upper fixing roller 71 is heated by radiant heat from the heater. The heat of the roller portion of the upper fixing roller 71 is transmitted to the paper S so that the toner image is fixed on the paper S.

The paper S is conveyed in a manner that the paper surface (object of fixing) bearing the toner image transferred by the secondary transfer part 60 faces the upper fixing roller 71, and passed through the fixing nip part.

Thus, the paper S passed through the fixing nip part is pressurized by the upper fixing roller 71 and lower fixing roller 72 and heated by the heat of the roller portion of the upper fixing roller 71.

A switching gate 24 is located downstream of the fixing section 70 in the paper S conveying direction. The switching gate 24 changes the conveyance path for the paper S which has passed through the fixing section 70. Specifically, if an image is formed on one face of the paper S and the paper is to be discharged with the image face up, the switching gate 24 makes the paper S move straight. Consequently, the paper S is discharged by a pair of discharge rollers 25. On the other hand, if an image is formed on one face of the paper S and the paper is to be discharged with the image face down, or if images are to be formed on both the faces of the paper S, the switching gate 24 guides the paper S downward.

If the paper is to be discharged with the image face down, after the paper S is guided downward by the switching gate 24, a paper reversal conveyor 26 reverses the paper S and conveys the paper S upward. Consequently, the reversed paper S is discharged by the pair of discharge rollers 25. If images are to be formed on both the faces of the paper S, after the paper S is guided downward by the switching gate 24, the paper reversal conveyor 26 reverses the paper S. Then, the reversed paper S is sent again to the transfer position through a paper refeed path 27.

[Control System Configuration of the Image Forming Apparatus]

Figure 3:
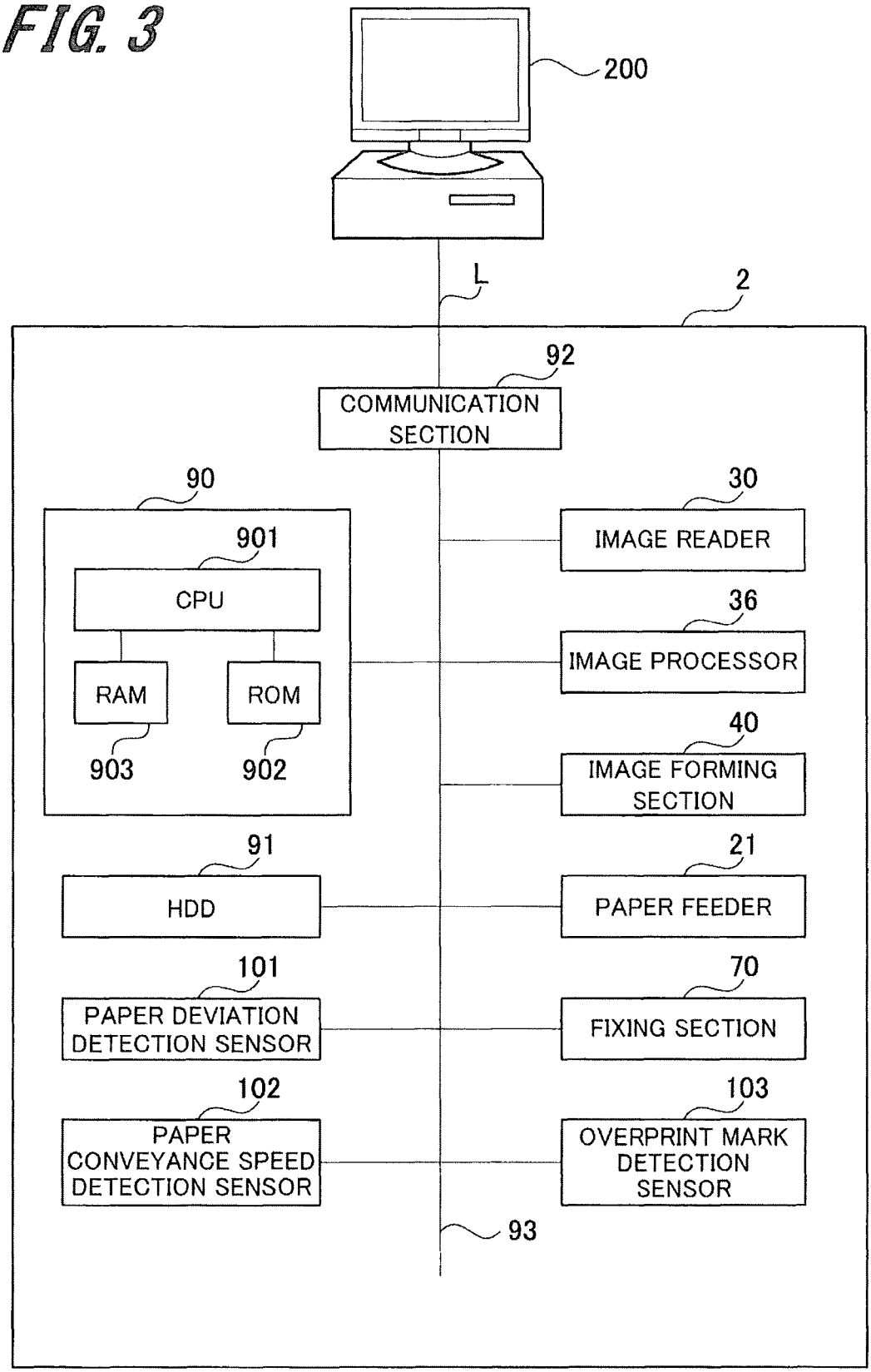
FIG. 3 is a block diagram which shows an example of the control system configuration of the image forming apparatus.

Next, the control system configuration of the image forming apparatus 1 will be described referring to FIG. 3. FIG. 3 is a block diagram which shows an example of the control system configuration of the image forming apparatus 1.

As shown in FIG. 3, the image forming apparatus 1 has a controller 90. The controller 90 is mounted on the control board 80 shown in FIG. 2.

For example, the controller 90 includes a CPU (Central Processing Unit) 901, ROM (Read Only Memory) 902 to store a program, etc. to be executed by the CPU 901, and RAM (Random Access Memory) 903 to be used as a working area for the CPU 901. For the ROM 902, an electrically erasable programmable ROM may be used.

The controller 90 is connected to the image reader 30, image processor 36, image forming section 40, paper feeder 21, fixing section 70, HDD (Hard Disk Drive) 91, communication section 92, paper deviation detection sensor 101, paper conveyance speed detection sensor 102, and overprint mark detection sensor 103 through a system bus 93 to control the entire image forming apparatus 1.

Specifically, the image forming apparatus 1 performs the following operations or processing steps under the control by the controller 90. Namely, the image reader 30 reads the image of the original G placed on the original feed tray 11 or the original placed on the original holder 31 and generates image data. The image data generated by the image reader 30 or image data sent from an external device connected to the image forming apparatus 1 is sent to the image processor 36. The image processor 36 performs image processing tasks, such as shading correction, image density adjustment, and image compression, on the received image data as necessary.

The image forming section 40 forms a toner image on the intermediate transfer belt 50 according to the image data generated by the image reader 30 or image data sent from the external device. The toner image is transferred to paper S fed by the paper feeder 21 at the secondary transfer part 60. The fixing section 70 pressurizes and heats the paper S to fix the toner image on the paper S.

The HDD 91 is an internal memory which stores the image data on the original image as read and acquired by the image reader 30 or stores image data which has been outputted and so on. The communication section 92 receives job information which is sent from a client PC 200 as an example of an external device through a communication line L, and sends the received job information to the controller 90 through the system bus 93. The job information contains the image data on the image to be formed and information associated with the image data, such as the type of paper to be used and the number of sheets of paper.

Here, the client PC 200 is assumed to be employed as the external device which sends the job information, but the external device is not limited thereto. Another type of device, for example, a facsimile apparatus, may be employed as the external device.

The paper deviation detection sensor 101 is an example of a paper deviation detector which detects deviation of paper being conveyed, namely continuous paper S, in the main scanning direction (direction perpendicular to the conveyance direction/width direction). For the paper deviation detection sensor 101, for example, a CCD or CMOS image sensor in which photosensitive elements (pixels) are arranged in line along a length more than the maximum width of the continuous paper S may be used as an in-line sensor which can detect an widthwise end of the continuous paper S.

The paper conveyance speed detection sensor 102 is an example of a paper conveyance speed detector which detects the speed of conveyance of continuous paper S. The paper conveyance speed detection sensor 102 may be, for example, an optical sensor which casts light on the image formation surface of the continuous paper S and reads a surface pattern image in a tiny area of the continuous paper S. Instead of this type of optical sensor, a transmission type sensor with a slit which includes a circular disk to rotate in conjunction with the rollers for conveying the continuous paper S and a combination of a light emitting element and a light receiving element facing each other with the slit between the elements may be used as the paper conveyance speed detection sensor 102.

Figure 4A:
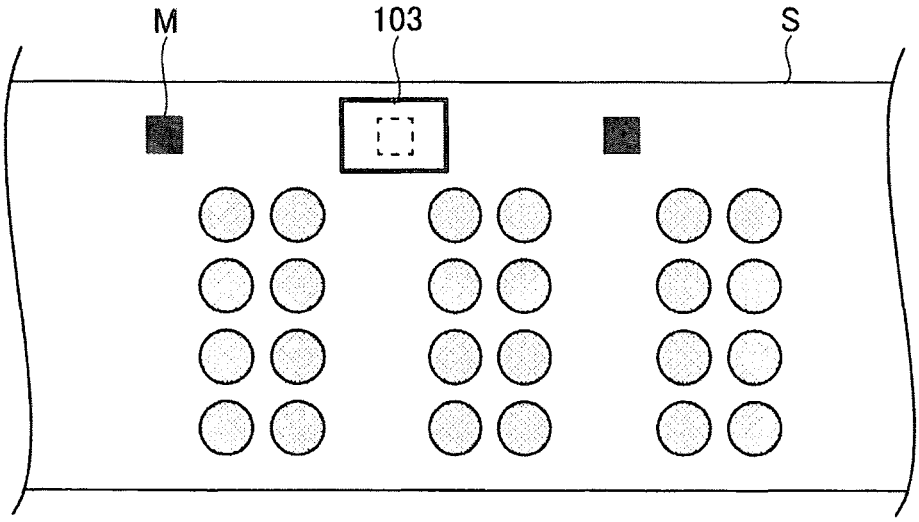
FIG. 4A shows an overprint mark on paper.
Figure 4B:
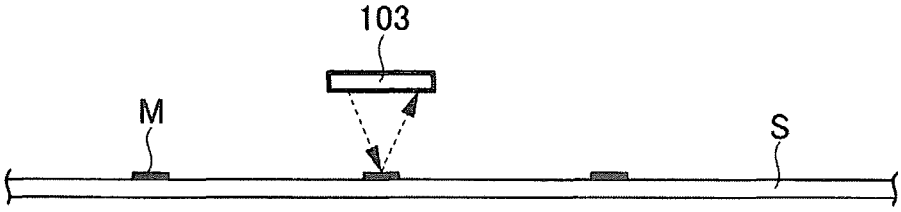
FIG. 4B shows an overprint mark detection sensor to detect an overprint mark on paper.

In order to perform overprinting, as shown in FIG. 4A, the continuous paper S bears an overprint mark M which determines an overprinting position (in other words, a sign indicating an overprinting position). The overprint mark detection sensor 103 is an example of an overprint mark detector which detects an overprint mark M on the continuous paper S. For example, as shown in FIG. 4B, the overprint mark detection sensor 103 may be a reflection type optical sensor which combines a light emitting element for casting light on an area with an overprint mark M on the continuous paper S and a light receiving element for receiving the reflected light from the overprint mark M.

[Overprinting]

Overprinting is a technique to print a desired image, such as barcode, on a printing surface on which a print has been once made. Overprinting is performed according to time of detection of an overprint mark M by the overprint mark detection sensor 103. In the printing equipment 100 which can perform overprinting, for high accuracy in printing, it is important to ensure the accuracy of a position where overprinting is performed, namely overprinting position. In order to ensure overprinting position accuracy, the printing equipment 100 must minimize instability in paper feed (errors).

One contributory factor for instability in paper feed is instability caused by fluctuations in travel path due to meandering in the width direction of the paper. In the case of continuous paper S in particular, meandering in the width direction of the paper may occur due to misalignment of conveying rollers or paper expansion/contraction caused by uneven paper tension.

The printing equipment 100 according to this embodiment is characterized by correcting paper feed errors in consideration of meandering in the width direction of the paper to enhance the overprinting position accuracy in overprinting. Correction of paper feed errors in consideration of paper meandering is made under the control by the controller 90 of the printing equipment 100. Next, the controller 90 which corrects paper feed errors in consideration of paper meandering will be explained concretely.

[Functions of the Controller]

Figure 5:
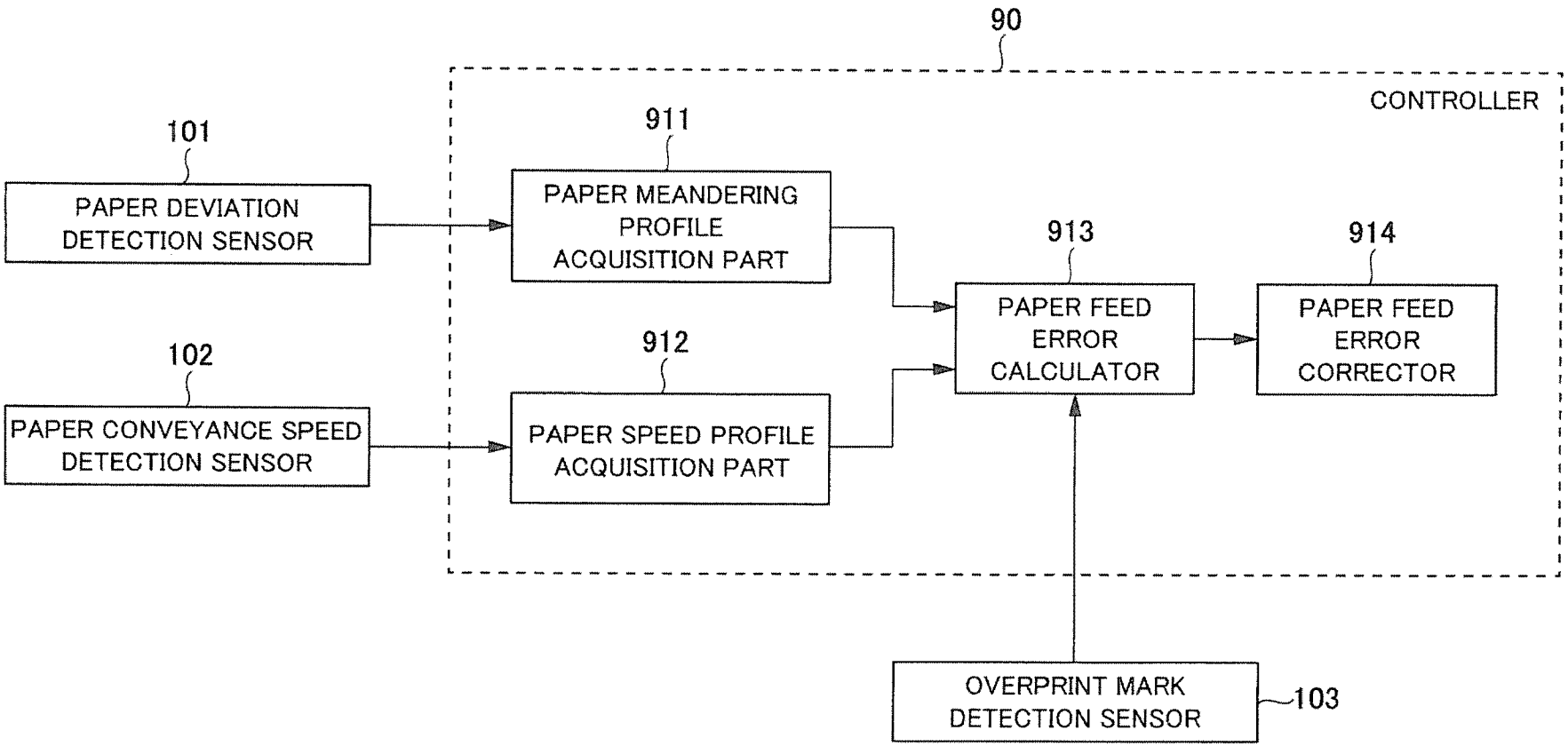
FIG. 5 is a functional block diagram which shows an example of the functions of a controller.

In the printing equipment 100 thus configured according to the embodiment, the controller 90 has not only the function to control the image reader 30, image processor 36, image forming section 40 and so on, but also the function explained below to correct paper feed errors in consideration of meandering in the width direction of the paper. FIG. 5 is a functional block diagram which shows an example of the functions of the controller 90.

As shown in FIG. 5, the controller 90 has various functional modules: a paper meandering profile acquisition part 911, paper speed profile acquisition part 912, paper feed error calculator 913, and paper feed error corrector 914. In other words, the paper meandering profile acquisition part 911, paper speed profile acquisition part 912, paper feed error calculator 913, and paper feed error corrector 914 are functional modules which are operated by software through the CPU 901 which interprets and executes the program to perform the functions.

Figure 6A:
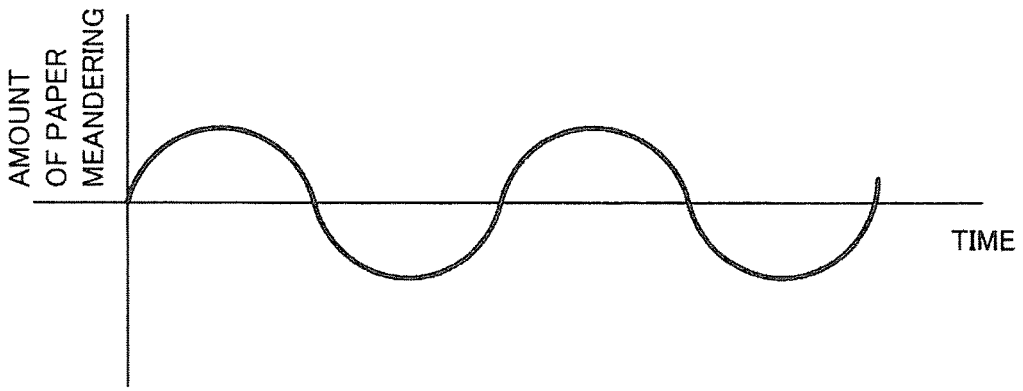
FIG. 6A is a waveform chart which explains a paper meandering profile.

The paper meandering profile acquisition part 911 acquires the profile of meandering in the width direction of continuous paper S (hereinafter referred to as "paper meandering profile") from a result of detection by the paper deviation detection sensor 101. An example of the paper meandering profile may be the cycle and amplitude of meandering. Meandering in the width direction of the paper has a cyclic nature and as shown in FIG. 6A, the cycle and amplitude (magnitude of meandering/amount of meandering) vary according to the type of paper or the conveyance speed.

Figure 6B:
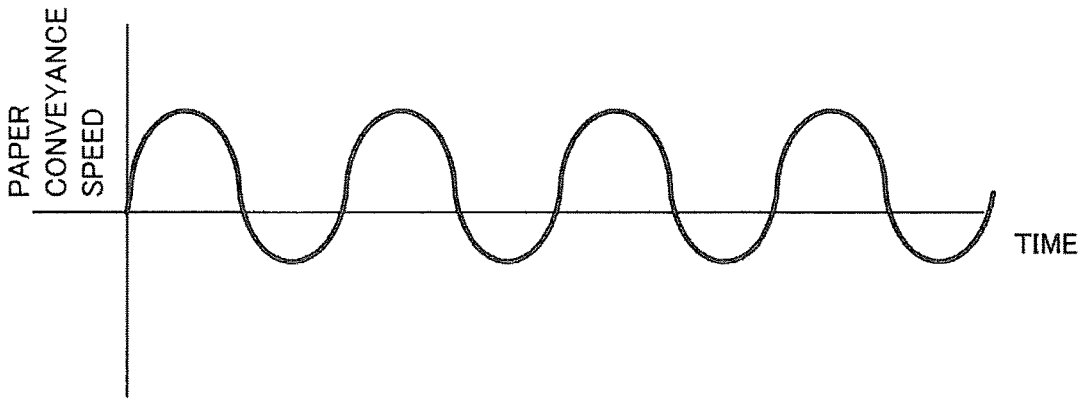
FIG. 6B is a waveform chart which explains a paper speed profile.

The paper speed profile acquisition part 912 acquires the profile of speed of conveyance of continuous paper S (paper conveyance speed) as shown in FIG. 6B (hereinafter referred to as "paper speed profile") from a result of detection by the paper conveyance speed detection sensor 102. The paper conveyance speed is also the rotation speed of the conveying rollers which convey the continuous paper S.

The paper feed error calculator 913 calculates a paper feed error (instability in paper feed) on the basis of the paper meandering profile acquired by the paper meandering profile acquisition part 911. The relational expression between the paper meandering profile and paper feed error can be previously stored, for example, in the ROM 902 of the controller 90 (see FIG. 3). Preferably, the paper feed error calculator 913 calculates a paper feed error on the basis of the paper meandering profile acquired by the paper meandering profile acquisition part 911 and the paper speed profile acquired by the paper speed profile acquisition part 912.

Acquisition of a paper meandering profile by the paper meandering profile acquisition part 911, acquisition of a paper speed profile by the paper speed profile acquisition part 912, and calculation of a paper feed error by the paper feed error calculator 913 can be performed before the image forming apparatus 1 starts printing, for example, during the warm-up period. Also, acquisition of a paper meandering profile, acquisition of a paper speed profile, and calculation of a paper feed error can be continued during printing and if a change from the previous value is found, the value can be updated.

The paper feed error corrector 914 corrects the timing for the image forming section 40 to form an image or the speed of the paper conveyance motor for conveying the continuous paper S, on the basis of the result of calculation based on the paper meandering profile acquired by the paper meandering profile acquisition part 911. Preferably the paper feed error corrector 914 corrects the timing for the image forming section 40 to form an image, on the basis of the result of calculation based on both the paper meandering profile acquired by the paper meandering profile acquisition part 911 and the paper speed profile acquired by the paper speed profile acquisition part 912.

Furthermore, in the printing equipment 100 which can perform overprinting, the paper feed error calculator 913 calculates a paper feed error in the zone from the point of detection of an overprint mark M by the overprint mark detection sensor 103 to the secondary transfer position in the image forming apparatus 1 on the basis of the paper meandering profile and paper speed profile. Preferably the paper feed error calculator 913 calculates a paper feed error in synchronization with the time of detection of an overprint mark M by the overprint mark detection sensor 103. Then, the paper feed error corrector 914 corrects the image formation timing or the paper conveyance motor speed on the basis of the result of calculation by the paper feed error calculator 913.

Here, in the printing equipment 100 which can perform overprinting, in order to make the time of detection of an overprint mark M by the overprint mark detection sensor 103 coincide with the time of acquisition of a paper meandering profile and a paper speed profile, preferably the sensors are positioned as follows. Specifically, it is preferable that the positions of the paper deviation detection sensor 101 and overprint mark detection sensor 103 should be in the same phase in the direction perpendicular to the conveyance direction of the paper S (width direction of the paper S), namely the sensors should be arranged linearly along the direction perpendicular to the conveyance direction.

As described above, in the printing equipment 100 according to this embodiment, a paper feed error is calculated on the basis of the paper meandering profile calculated from the result of detection by the paper deviation detection sensor 101 and the image formation timing is corrected on the basis of the calculation result. Thus, since a paper feed error is corrected in consideration of meandering in the width direction of the paper, the overprinting position accuracy in overprinting is enhanced, so higher accuracy can be achieved in overprinting.

Alternatively, instability in paper feed due to paper meandering can be reduced by suppressing meandering in the width direction of the paper S. However, suppression of meandering in the width direction of the paper S requires a structurally complicated steering mechanism and results in higher cost. On the other hand, in the printing equipment 100 according to this embodiment, it is unnecessary to use a structurally complicated steering mechanism, so instability in paper feed (paper feed error) can be suppressed at lower cost.

Figure 7:
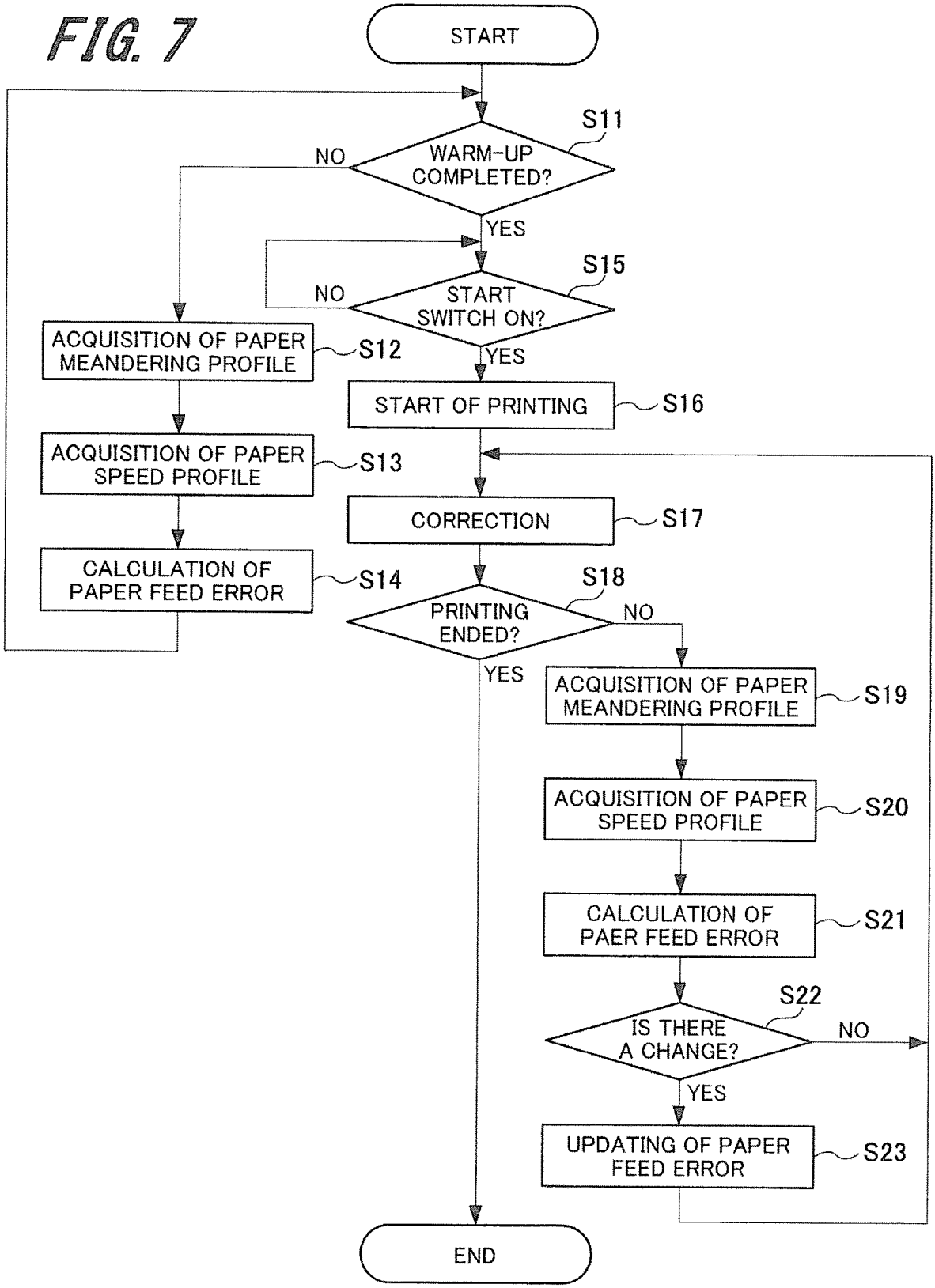
FIG. 7 is a flowchart which shows an example of the control sequence of a printing method according to the present invention.

Next, an example of the control sequence of a printing method for the printing equipment 100 according to this embodiment (printing method according to the present invention) will be explained referring to FIG. 7. FIG. 7 is a flowchart which shows an example of the control sequence of the printing method according to the present invention. The series of processing steps are carried out under the control by the CPU 901 of the controller 90 of the image forming apparatus 1 (see FIG. 3).

The CPU 901 decides whether or not warm-up is completed (Step S11) and if warm-up is underway (No at S11), the CPU 901 acquires a paper meandering profile from the result of detection by the paper deviation detection sensor 101 (Step S12/paper meandering profile acquisition step). Then, the CPU 901 acquires a paper speed profile from the result of detection by the paper conveyance speed detection sensor 102 (Step S13/paper speed profile acquisition step), then calculates a paper feed error on the basis of the paper meandering profile and paper speed profile (Step S14/paper feed error calculation step), and then goes back to Step S11.

Therefore, during the warm-up period prior to start of printing, acquisition of a meandering profile, acquisition of a paper speed profile, and calculation of a paper feed error are performed in the process from Step S11 to Step S14.

If warm-up is completed (Yes at S11), the CPU 901 monitors whether or not the printing start switch is turned on (Step S15) and if the CPU 901 detects that the printing start switch has been turned on (Yes at S15), printing is started (Step S16). Then, the CPU 901 corrects, for example, the image formation timing on the basis of the paper feed error calculated at Step S14 (Step S17/correction step). Then, the CPU 901 decides whether or not printing is ended (Step S18) and if printing is ended (Yes at S18), the CPU 901 ends the series of processing steps.

If printing is underway (No at S18), the CPU 901 acquires a paper meandering profile from the result of detection by the paper deviation detection sensor 101 (Step S19/paper meandering profile acquisition step). Then, the CPU 901 acquires a paper speed profile from the result of detection by the paper conveyance speed detection sensor 102 (Step S20/paper speed profile acquisition step), then calculates a paper feed error on the basis of the paper meandering profile and paper speed profile (Step S21/paper feed error calculation step).

Then, the CPU 901 decides whether or not there is a change in paper feed error from the previous value (Step S22) and if there is no change in paper feed error (No at S22), the CPU 901 goes back to Step S17. In this case, at Step S17, correction is made on the basis of the paper feed error calculated at Step S14.

If there is a change in paper feed error, the CPU 901 updates the paper feed error (Step S23) and then goes back to Step S17. Thus, through the process from Step S19 to Step S23, even while printing is underway, acquisition of a paper meandering profile, acquisition of a paper speed profile, and calculation of a paper feed error are continuously performed and the paper feed error (instability in paper feed) is updated. At Step S17, correction is made on the basis of the paper feed error updated at Step S23.

<Variations>

Although an embodiment of the present invention has been so far explained, the invention is not limited thereto. The above embodiment may be altered or modified in various ways without departing from the gist of the invention. Such altered or modified embodiments are also within the technical scope of the invention.

For example, the above embodiment has been described on the assumption that the printing equipment 100 according to the present invention is continuous paper printing equipment which performs printing on continuous paper S and corrects paper feed errors in consideration of meandering in the width direction of the continuous paper S, but the present invention can be applied not only to continuous paper printing equipment. The present invention can be applied to any type of printing equipment that may cause the paper to meander in the paper width direction, including printing equipment 100 which is a stand-alone image forming apparatus.

In the above embodiment, the printing equipment is operated by software through the CPU 901 which interprets and executes the program to perform the function of each of the functional modules (911 to 914) of the controller 90, but the invention is not limited thereto. Specifically, some or all of the functional modules (911 to 914) of the controller 90 can be designed, for example, as an integrated circuit so that the module functions can be embodied as hardware.

In the above embodiment, a paper feed error is calculated on the basis of a meandering profile and a paper speed profile and the image formation timing is corrected on the basis of the calculated paper feed error. However, the amount of correction of image formation timing can be varied according to the type of paper or printing speed.

Although embodiments of the present invention have been described and illustrated in detail, the disclosed embodiments are made for purposes of illustration and example only and not limitation The scope of the present invention should be interpreted by terms of the appended claims

REFERENCE SIGNS LIST

1 . . . image forming apparatus,
2 . . . paper feed device
3 . . . paper take-up device
4 . . . paper feed adjuster,
5 . . . discharged paper adjuster,
6 . . . operation display
10 . . . original conveyor,
20 . . . paper case,
30 . . . image reader,
40 . . . image forming section,
50 . . . intermediate transfer belt,
60 . . . secondary transfer part,
70 . . . fixing section,
90 . . . controller,
100 . . . printing equipment,
101 . . . paper deviation detection sensor,
102 . . . paper conveyance speed detection sensor,
103 . . . overprint mark detection sensor,
911 . . . paper meandering profile acquisition part,
912 . . . paper speed profile acquisition part,
913 . . . paper feed error calculator,
914 . . . paper feed error corrector

What is claimed is:

1. Printing equipment comprising:

a paper deviation detector for detecting deviation of paper being conveyed, in a main scanning direction;

a paper meandering profile acquisition part for acquiring a profile of meandering in a width direction of the paper from a result of detection by the paper deviation detector;

a paper feed error calculator for calculating a paper feed error on the basis of the meandering profile acquired by the paper meandering profile acquisition part;

a corrector for correcting image formation timing on the basis of a result of calculation by the paper feed error calculator;

a paper feed device for feeding continuous paper as the paper;

an image forming apparatus for forming an image on the continuous paper fed from the paper feed device;

a paper take-up device for winding up the continuous paper after formation of the image in the image forming apparatus;

an overprint mark detector for detecting an overprint mark on the paper so that the image forming apparatus can perform overprinting according to time of detection of the mark by the overprint mark detector;

a paper conveyance speed detector for detecting a conveyance speed of the paper; and a paper speed profile acquisition part for acquiring a profile of conveyance speed of the paper from a result of detection by the paper conveyance speed detector, wherein the paper feed error calculator calculates a paper feed error in a zone from detection of the mark by the overprint mark detector to a secondary transfer position in the image forming apparatus, on the basis of the meandering profile acquired by the paper meandering profile acquisition part and the paper speed profile acquired by the paper speed profile acquisition part, and the corrector corrects the image formation timing or a paper conveyance motor speed, on the basis of a result of calculation by the paper feed error calculator.

2. The printing equipment according to claim 1, wherein the paper feed error calculator calculates the paper feed error before start of printing.

3. The printing equipment according to claim 2, wherein the paper feed error calculator continues to calculate the paper feed error even during printing, and if a change from a previous value is found, updates the paper feed error.

4. Printing equipment comprising:

a paper deviation detector for detecting deviation of paper being conveyed, in a main scanning direction;

a paper meandering profile acquisition part for acquiring a profile of meandering in a width direction of the paper from a result of detection by the paper deviation detector;

a paper feed error calculator for calculating a paper feed error on the basis of the meandering profile acquired by the paper meandering profile acquisition part;

a corrector for correcting image formation timing on the basis of a result of calculation by the paper feed error calculator;

wherein the corrector corrects a speed of a paper conveyance motor on the basis of a result of calculation by the paper feed error calculator.

5. Printing equipment comprising:

a paper deviation detector for detecting deviation of paper being conveyed, in a main scanning direction;

a paper meandering profile acquisition part for acquiring a profile of meandering in a width direction of the paper from a result of detection by the paper deviation detector;

a paper feed error calculator for calculating a paper feed error on the basis of the meandering profile acquired by the paper meandering profile acquisition part;

a corrector for correcting image formation timing on the basis of a result of calculation by the paper feed error calculator;

a paper conveyance speed detector for detecting a conveyance speed of the paper; and a paper speed profile acquisition part for acquiring a profile of conveyance speed of the paper from a result of detection by the paper conveyance speed detector, wherein the paper feed error calculator calculates a paper feed error on the basis of the meandering profile acquired by the paper meandering profile acquisition part and the paper speed profile acquired by the paper speed profile acquisition part, and the corrector corrects the image formation timing on the basis of the result of calculation by the paper feed error calculator.

6. The printing equipment according to claim 1, wherein the paper feed error calculator calculates the paper feed error in synchronization with the time of detection of the mark by the overprint mark detector.

7. The printing equipment according to claim 1, wherein the paper deviation detector, the paper conveyance speed detector, and the overprint mark detector are arranged in the same phase in a direction perpendicular to a conveyance direction of the paper.

8. A printing method for printing equipment having a paper deviation detector for detecting deviation of paper being conveyed, in a main scanning direction, the method using a non-transitory computer-readable storage medium storing a program causing a computer to perform:

acquiring a profile of meandering in a width direction of the paper from a result of detection by the paper deviation detector (paper meandering profile acquisition step);

calculating a paper feed error on the basis of the meandering profile acquired at the paper meandering profile acquisition step (paper feed error calculation step); and correcting image formation timing on the basis of a result of calculation at the paper feed error calculation step (correction step);

wherein the printing equipment comprising:

a paper feed device for feeding continuous paper as the paper;

an image forming apparatus for forming an image on the continuous paper fed from the paper feed device;

a paper take-up device for winding up the continuous paper after formation of the image in the image forming apparatus;

an overprint mark detector for detecting an overprint mark on the paper; and a paper conveyance speed detector for detecting a conveyance speed of the paper, wherein the printing equipment enables the image forming apparatus to perform overprinting according to time of detection of the mark by the overprint mark detector, the paper speed profile acquisition step to acquire a profile of the conveyance speed of the paper from a result of detection by the paper conveyance speed detector is performed, at the paper feed error calculation step, a paper feed error in a zone from detection of the mark by the overprint mark detector to a secondary transfer position in the image forming apparatus is calculated on the basis of the meandering profile acquired at the paper meandering profile acquisition step and the paper speed profile acquired at the paper speed profile acquisition step, and at the correction step, the image formation timing or a paper conveyance motor speed is corrected on the basis of a result of calculation at the paper feed error calculation step.

* * * * *